US007665498B2

(12) United States Patent
Bredl et al.

(10) Patent No.: US 7,665,498 B2
(45) Date of Patent: Feb. 23, 2010

(54) TAPE MONITORING SYSTEM

(75) Inventors: John F. Bredl, Hudson, WI (US); Craig R. Smythe, Lino Lakes, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 821 days.

(21) Appl. No.: 11/280,137

(22) Filed: Nov. 15, 2005

(65) Prior Publication Data

US 2007/0107825 A1 May 17, 2007

(51) Int. Cl.
*B32B 41/00* (2006.01)

(52) U.S. Cl. ..... 156/351; 156/361; 156/363; 156/368; 156/378; 156/379

(58) Field of Classification Search ..... 156/64, 156/351, 361, 363, 368, 378, 379
See application file for complete search history.

(56) References Cited

U.S. PATENT DOCUMENTS

| | | | | |
|---|---|---|---|---|
| 3,989,574 | A | 11/1976 | Evans | |
| 4,449,433 | A | 5/1984 | Miyamoto | |
| 4,538,398 | A | 9/1985 | Marchetti | |
| 4,548,022 | A | 10/1985 | Yaklin | |
| 4,554,042 | A | 11/1985 | Marchetti | |
| 4,585,504 | A | 4/1986 | Marchetti | |
| 4,640,731 | A | 2/1987 | Lerner et al. | |
| 4,687,535 | A | 8/1987 | Voltmer | |
| 4,707,211 | A | 11/1987 | Shibata | |
| 4,836,873 | A | 6/1989 | Mitanihara et al. | |
| 4,846,921 | A | 7/1989 | Lerner et al. | |
| 4,855,006 | A | 8/1989 | Marchetti | |
| 5,228,943 | A | 7/1993 | Vasilakes | |
| 5,507,907 | A | 4/1996 | Kropp et al. | |
| 5,735,101 | A | 4/1998 | Shing-Tak Lam | |
| 6,432,528 | B1 | 8/2002 | Faust et al. | |
| 6,884,312 | B2 | 4/2005 | Mitchell et al. | |
| 2003/0189490 | A1 | 10/2003 | Hogerton et al. | |
| 2005/0230051 | A1 * | 10/2005 | Yamamoto et al. | 156/361 |

FOREIGN PATENT DOCUMENTS

| | | |
|---|---|---|
| JP | 2001-122507 | 5/2001 |

* cited by examiner

*Primary Examiner*—George R Koch, III

(57) ABSTRACT

The invention provides a tape monitoring system for use with a taping machine that is mounted independent of a taping head. The tape monitoring system includes a tape dispensing sensor for determining whether tape is being dispensed from the tape supply and capable of providing a signal relating to a tape dispensing velocity, an object presence sensor for determining whether an object is present for taping and capable of providing a response when the object is present, and a control system operatively connected to the tape dispensing sensor and the object presence sensor for determining a potential error condition.

15 Claims, 9 Drawing Sheets

TAPE MONITORING SYSTEM

BACKGROUND

The present invention relates to a tape sensor system that monitors the tape application by taping machines to boxes.

The use of pressure-sensitive adhesive tape for the purpose of sealing boxes, and more specifically box flaps, is generally known. Moreover, it is known that cartons or boxes which are continuously moved along a conveyor can be automatically sealed by such adhesive tape.

Box sealing machines have been developed for applying lengths of tape to boxes as they are moved through such machines in a continuous manner. Moreover, such box sealing machines are known to be provided as part of a packaging line where the boxes are fed continuously to the box sealing machine from which the sealed boxes are further conveyed for further processing, such as palletizing, shipping, etc. Boxes are typically sealed on one or more sides, and such box sealing machines typically provide taping heads of a number corresponding to the number of box sides to be sealed. The taping heads may be arranged to seal the top and bottom box flaps, opposite side flaps, or any combination thereof.

Such box sealing machines, like any other machine within the packaging line, when down, have the potential to slow down or even stop the entire packaging line. Thus, it is beneficial to minimize such down time. Unless the adhesive tape is supplied to the box sealing machine by a continuous tape supply that is of indefinite length, the box sealing machine will need to be stopped on a regular basis to change tape supply rolls. Minimizing other down time is highly desirable.

It is not only important to minimize machine down time, it is also important to minimize improper taping and sealing of boxes. Further in this regard, it is desirable to detect any improper taping or other errors within the packaging line so that it can be corrected as soon as possible. Of course, the longer that it takes to detect such error, the more boxes that are improperly sealed and which must be redone.

The monitoring of equipment in general as well as the monitoring of product exiting any production line for quality purposes is well known. Such monitoring includes the use of a wide variety of inspection systems which rely on many different kinds of sensors depending on the object being monitored. Typical sensors include cameras, optical sensors, mechanical sensors, magnetic sensors, electrical sensors, and the like, which are typically provided as part of a controlled system which includes a feedback loop or circuit which may control such processing equipment. Moreover, it is generally known that if certain errors are detected, machines may be actually shut down until a correction is made. Examples of labeling machines having sensing systems which disable certain machine functions upon the detection of a missing label are described in U.S. Pat. Nos. 4,687,535 (Voltmer) and U.S. Pat. No. 3,989,574 (Evans).

With regard to box sealing machines, it is well known to use a variety of sensors, such as mechanical switches, optical sensors, photo cells, electrical switches, and the like, to control the taping operation of a box driven through such machine. Typically, such sensors detect the position of the box as it is moved through the machine and controls specific taping operations based on the detected box position. Examples of such taping machines including control sensors can be found in U.S. Pat. Nos. 4,846,921 (Lerner et al.); U.S. Pat. No. 4,836,873 (Mitanihara et al.); U.S. Pat. No. 4,640,731 (Lerner et al.); U.S. Pat. Nos. 4,585,504, 4,554,042, and 4,538,398 (Marchetti); and U.S. Pat. No. 4,548,022 (Yaklia). The sensing systems of these machines, however, are not provided with the sensing error conditions. Moreover, they do not provide a feedback for disabling any function of the machines.

On other box sealing machines, a variety of sensors are integrated directly into the taping unit, taping head, or taping applicator. (See, for example, U.S. Pat. No. 4,855,006 (Marchetti); electrically controlled U.S. Pat. No. 5,507,907 (Kropp et al.); and U.S. Pat. No. 5,735,101 (Belcor)).

In another example, a sensor system for use with a "taping head" is provided to sense the tape feed so that it is possible to stop the machine if the tape feed ceases (i.e., supply tape is depleted or tape breaks) or continues to dispense (i.e., tape does not cut). A dispensing sensor is positioned along the "tape guide path" of the "taping head" for determining whether tape is being dispensed from the taping head. A sensor is positioned on the taping head for indirectly determining whether an object is present for taping and a control system is connected to the tape dispensing sensor and an object sensor is used in determining a potential error condition.

In another example, a tape management system for use in a "taping applicator" is provided to sense the tape feed so that it is possible to stop the machine if the tape feed ceases or continues to dispense. Sensors are mounted on to the taping applicator where a detector having a feeler arm is positioned to bear against the tape on the tape path when the front roller is moved into the sensing position. The detector system can detect the tape and activate a warning system in the event no tape is detected or sense when the tape cutter has failed to cut the tape.

Another approach has been to mount sensors directly onto the box-sealing machine whereby the sensors look directly at the presence of the tape media. This approach provides information on the presence (or no presence) of tape, but does not provide any information on whether the tape is moving.

SUMMARY

In one aspect, the invention provides a tape monitoring system for use with a taping device that includes at least one taping head and a tape supply for applying tape to an object as the object is moved relative to the taping head. In one embodiment, the tape monitoring system comprises a tape dispensing sensor for determining whether tape is being dispensed from the tape supply and capable of providing a signal relating to a tape dispensing velocity, an object presence sensor for determining whether an object is present for taping and capable of providing a response when the object is present, and a control system operatively connected to the tape dispensing sensor and the object presence sensor for determining a potential error condition if either (A) the object presence sensor provides a response and the tape dispensing velocity is less than a first preset tape dispensing velocity, or (B) the object presence sensor no longer provides a response and the tape dispensing velocity is greater than a second preset tape dispensing velocity. The tape monitoring system is desirably independent of the taping head.

In another aspect, the invention provides a taping device comprising at least one taping head capable of applying tape to an object as the object is moved relative to the taping head, a tape supply for the taping head, and a tape monitoring system that comprises a tape dispensing sensor for determining whether tape is being dispensed from the tape supply and capable of providing a signal relating to a tape dispensing velocity, an object presence sensor for determining whether an object is present for taping and capable of providing a response when the object is present, and a control system operatively connected to the tape dispensing sensor and the object presence sensor for determining a potential error condition if either (A) the object presence sensor provides a response and the tape dispensing velocity is less than a first preset tape dispensing velocity, or (B) the object presence sensor no longer provides a response and the tape dispensing velocity is greater than a second preset tape dispensing velocity. The tape monitoring system is desirably independent of the taping head.

In another aspect, the invention provides a method of determining a potential error condition in a taping device wherein the taping device includes at least one taping head and a tape supply for applying tape to an object as the object is moved relative to the taping head. In one embodiment, the method comprises the steps of determining whether tape is being dispensed from the tape supply using a tape dispensing sensor capable of providing a signal relating to a tape dispensing velocity, determining whether an object is present for taping using an object presence sensor capable of providing a response when the object is present, and determining a potential error condition if either (A) the object presence sensor provides a response and the tape dispensing velocity is less than a first preset tape dispensing velocity, or (B) the object presence sensor no longer provides a response and the tape dispensing velocity is greater than a second preset tape dispensing velocity using a control system operatively connected to the tape dispensing sensor and the object presence sensor.

DETAILED DESCRIPTION

The invention provides a tape monitoring and control system for use with a taping machine and includes a tape dispensing sensor, a sensor for detecting a box, and a control system capable of receiving inputs from the sensors and providing a warning and/or interrupting power to the taping machine in the event of a potential error condition. The tape monitoring system of the invention is capable of determining potential error conditions including: tape was not applied to a box because the tape supply is depleted, the tape broke, or the tape is not properly located to be applied to a box; and the tape was not cut after being applied to the box. In other embodiments, the tape monitoring system can also determine an error condition when the tape supply is running low. Desirably, the tape monitoring system is located independent of a taping head. This remote location of the tape monitoring system allows easy removal and replacement of the taping head in a taping device.

Figure 1:
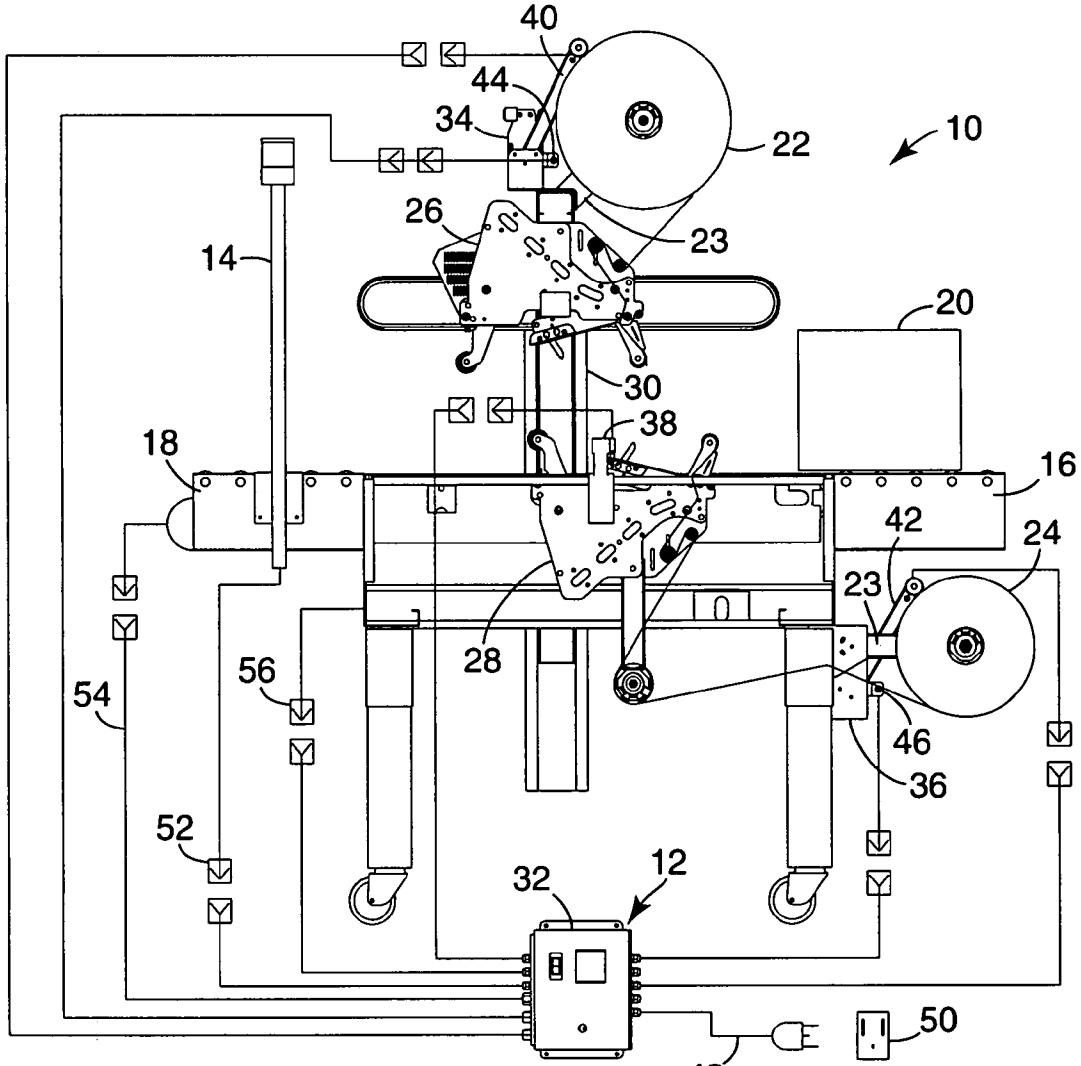
FIG. 1 is a schematic drawing of a box sealing machine combined with an embodiment of a warning device and a tape monitoring system in accordance with the present invention.

With reference to the drawings, wherein like numerals are used to designate like components throughout the several figures, and initially to FIG. 1, a box sealing machine 10 is schematically illustrated and is connected with a tape monitoring system 12 and a warning device 14. An entrance conveyor 16 and an exit conveyor 18 are also shown which together with the box sealing machine 10 define the path over which a box 20 is directed for sealing the box flaps with pressure-sensitive adhesive box sealing tape supplied from upper and lower tape supply rolls 22 and 24, respectively, mounted generally on the base of the box sealing machine with support arms 23. The illustrated box sealing machine 10 of FIG. 1 includes an upper taping head 26 and a lower taping head 28 for providing tape to both the upper and lower surfaces of the box 20 as it is driven through the box sealing machine 10. However, it is understood that the subject invention is just as applicable to box sealing machines that have but a single taping head, or to those that include one or more taping heads arranged differently, or to those having tape supply rolls mounted at further distances from the taping heads. For example, one or more sides of the box 20 can be sealed instead of the top and bottom flaps. The upper taping head 26 is preferably adjustably mounted to the base of the box sealing machine 10 by a pair of adjustable columns 30, which are conventionally known, and which permit the box sealing machine 10 to accommodate a wide variety of box sizes.

In one embodiment, the tape monitoring system 12 of the present invention comprises a control system 32 operatively connected to upper and lower tape monitors 34 and 36, respectively, and an object presence sensor 38. In this embodiment, upper and lower tape monitors 34, 36 comprise upper and lower tape dispensing sensors 40 and 42, respectively, and upper and lower tape supply sensors 44 and 46, respectively. Upper and lower tape monitors 34, 36 are mounted generally on frame members attached to the base of the box sealing machine, and independent from taping heads 26, 28.

Power is supplied to the box sealing machine 10 and the control system 32 via a power cord 48 connected to an AC power source 50. Power output lines, 52, 54, 56, extend from the control system 32 to warning device 14, exit conveyor 18, and box sealing machine 10, respectively. If a potential error condition is detected, power may be removed or applied to any or all of the power output connections or lines 52, 54, 56. Control system 32 monitors for proper tape application to box 20 as it moves through box sealing machine 10 and acts like a switching circuit by removing power to connection 56 if an error is detected and reinstates power to connection 56 once the error has been cleared. Control system 32 also has the ability to remove or apply power to connection 54, which sources power to an exit conveyor 18. If an error is detected, removing power to the exit conveyor could prevent boxes from exiting the box sealing machine 10 before power can be removed from the box sealing connection 56. An optional switched output power line connection 52 provides power to warning device 14. Warning device 14 could be a light beacon, audio alarm, or input to a remote control system that could flash, sound an alarm, or provide an error signal to the remote control system in response to a tape fault, or low tape condition.

Figure 5:
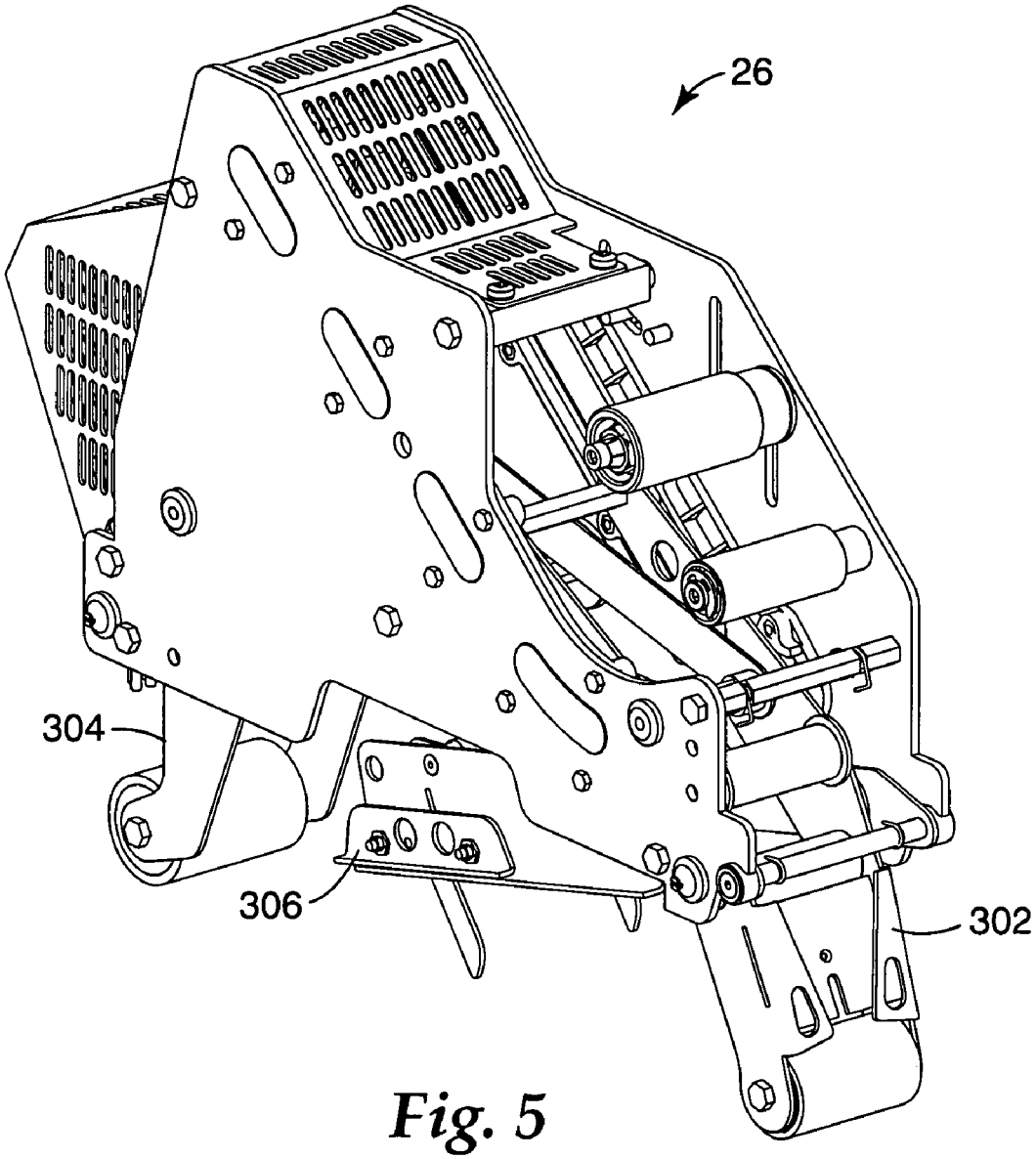
FIG. 5 is a view of an exemplary upper taping head usable in a box sealing machine and with a tape monitoring system of the invention.
Figure 6:
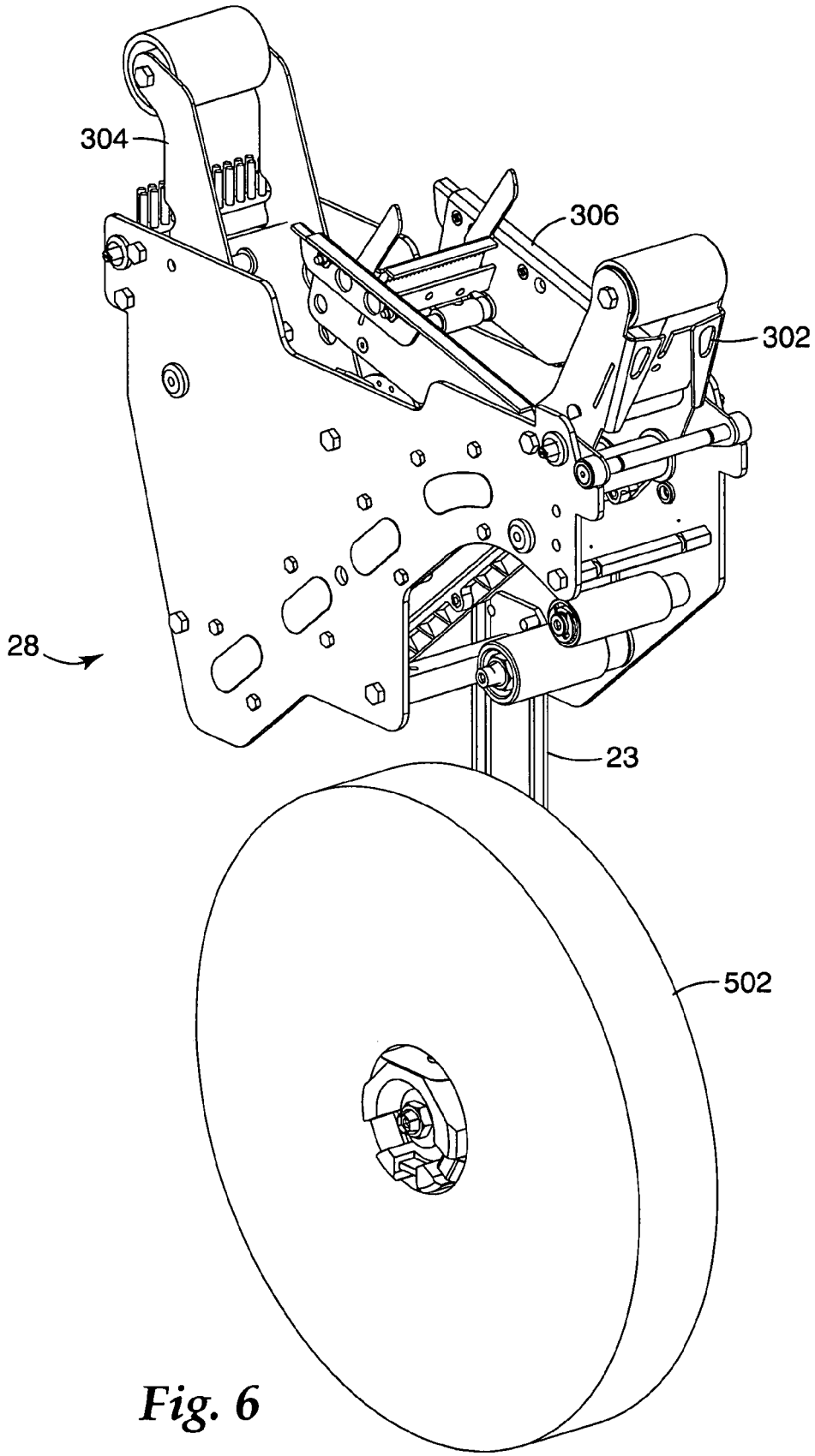
FIG. 6 is a view of an exemplary lower taping head usable in a box sealing machine and with a tape monitoring system of the invention.

The taping heads 26, 28 that are illustrated in FIG. 1 are standard taping heads available from 3M Company, St. Paul, Minn., and sold under the trade designation "ACCUGLIDE". The taping heads are mounted onto the box sealing machine and are independent from the tape monitors. Thus, the taping heads may be removed from the box sealing machine, for example, for service, without disconnecting the tape monitors or object presence sensor. As shown in more detail in FIGS. 5 and 6, upper and lower taping heads 26, 28 comprise a tape application arm assembly 302 for applying tape to a box and which moves from an extended position (shown) to a retracted position (not shown), a buffing arm assembly 304 for buffing tape to a box and which moves from an extended position (shown) to a retracted position (not shown), and a cutting arm assembly 306 which cuts the applied tape and which pivots from an extended position (shown) to a retracted position (not shown). Further details of this particular taping head may be found in U.S. Pat. No. 5,228,943 (Vasilakes), incorporated by reference herein for the description of taping heads.

Figure 2:
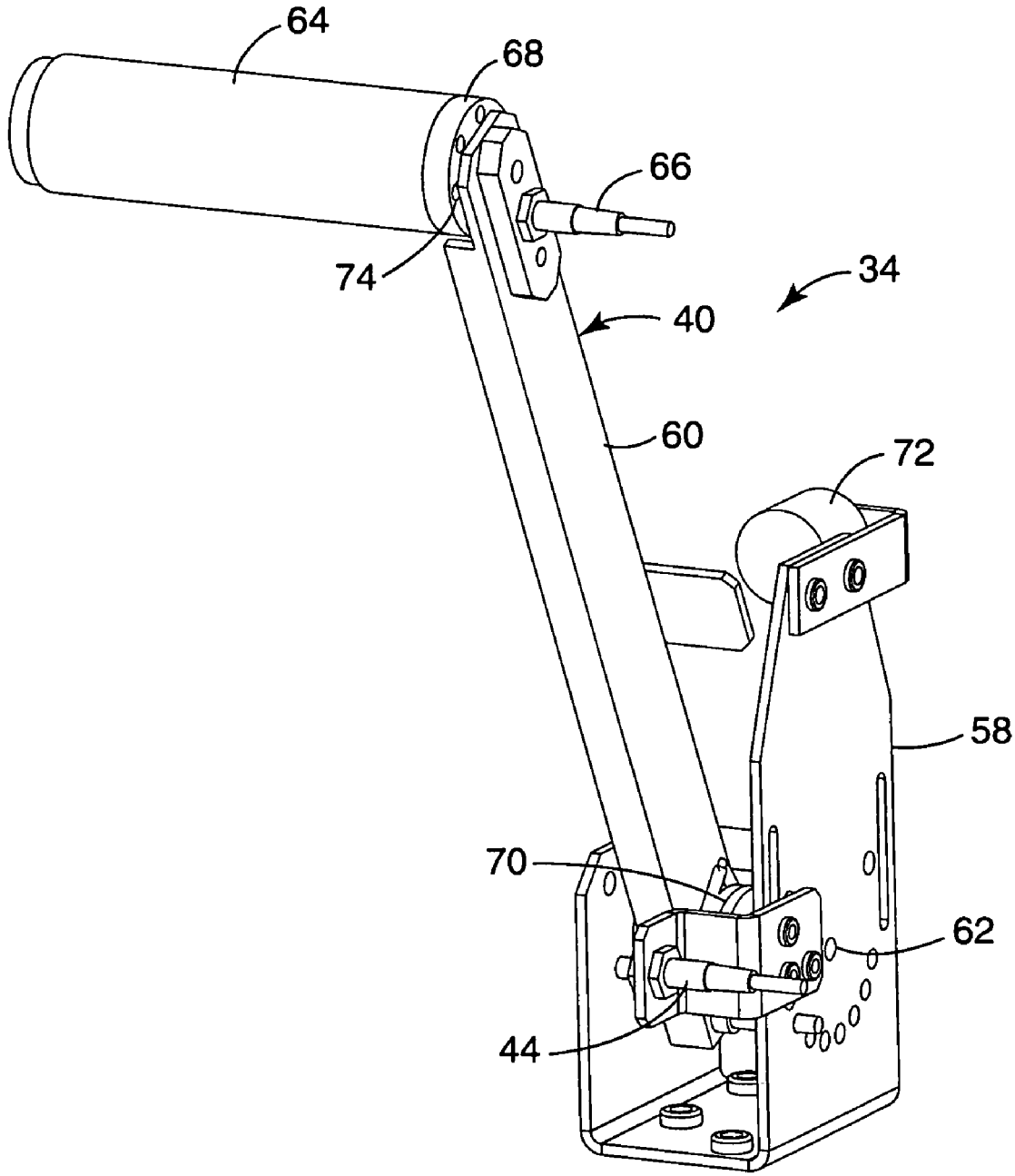
FIG. 2 is a view of an embodiment of an upper tape monitor for use in a tape monitoring system in accordance with the invention.

Referring now to FIG. 2, in this embodiment, upper tape monitor 34 comprises tape dispensing sensor 40 and tape supply sensor 44 mounted on a bracket 58. In one embodiment, tape dispensing sensor 40 comprises a dancer arm 60 that pivots on a shaft 62 at one end and a roller 64 rotatively mounted on the other end of the dancer arm. Dispensing proximity sensor 66 is mounted on the end of the dancer arm where the roller 64 is mounted and on an opposite surface adjacent the roller end 68. A torsion spring 70 provides moment force to the dancer arm so that roller 64 stays in contact with the tape supply roll (not shown). A magnet 72 is mounted on the frame to secure dancer arm in a position away from the tape supply roll in order to more easily load or remove a tape supply roll. Targets 74 are mounted on the roller end and are detectable by the dispensing proximity sensor 66. Rotation of the roller 64, and thus, the tape supply roll in contact with the roller, is detected by the targets 74 passing by the dispensing proximity sensor 66. Dispensing proximity sensor 66 is capable of providing an "ON" signal to the control system 32 as each target 74 passes by the dispensing proximity sensor 66 and an "OFF" signal as each target 74 passes away from the dispensing proximity sensor 66, generating an "ON/OFF" pulse train signal to the control system 32.

In this embodiment, tape supply sensor 44 is a proximity sensor mounted on bracket 58 and mounted in close proximity to the motion plane of the dancer arm 60 and capable of providing a signal to the control system 32 when dancer arm pivots in response to a low or depleted tape supply, and passes over or blocks the proximity sensor.

Figure 3:
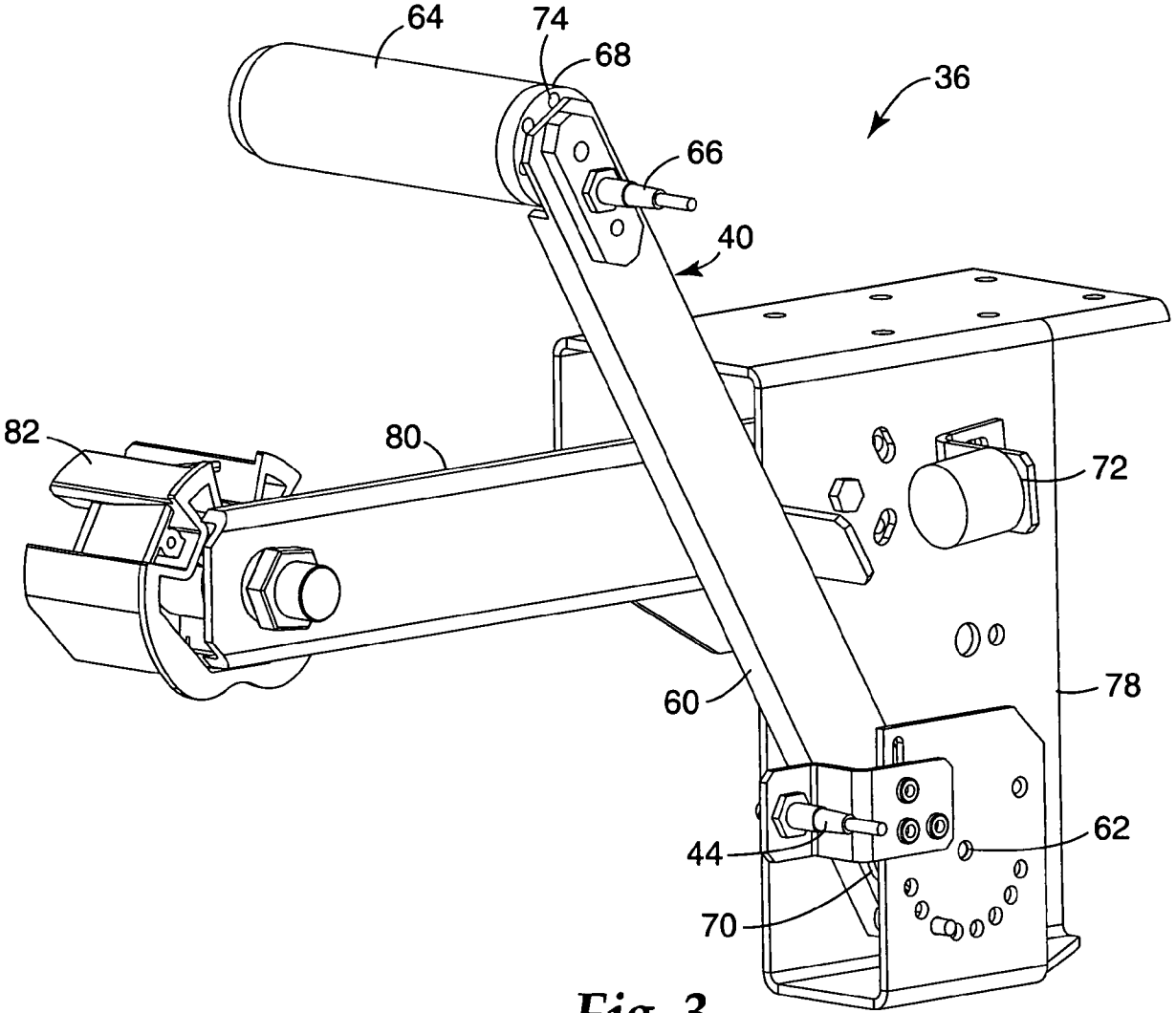
FIG. 3 is a view of an embodiment of a lower tape monitor for use in a tape monitoring system in accordance with the invention.

FIG. 3 shows an embodiment of a lower tape monitor 36 comprising tape dispensing sensor 40 and tape supply sensor 44 mounted on a bracket 78. In this embodiment, tape dispensing sensor 40 comprises a dancer arm 60 that pivots on a shaft 62 at one end and having a roller 64 rotatably mounted on the other end of the dancer arm. A dispensing proximity sensor 66 is mounted on the end of the dancer arm where the roller 64 is mounted and on an opposite surface adjacent the roller end 68. A torsion spring 70 provides moment force to the dancer arm so that roller 64 stays in contact with the tape supply roll (not shown). A magnet 72 is mounted on the frame to secure dancer arm in a position away from the tape supply roll in order to more easily load or remove a tape supply roll. Targets 74 are mounted on the roller end and are detectable by the dispensing proximity sensor 66. Like the upper dispensing sensor, rotation of the roller 64, and thus, the tape supply roll in contact with the roller, is detected by the targets 74 passing by the dispensing proximity sensor 66 generating an "ON/OFF" pulse train signal to the control system 32 as the roller 64 turns. In this embodiment, a tape supply roll mounting arm 80 is mounted to the bracket 78 at one end, and a tape supply roll support hub 82 is shown rotatably mounted to the other end of the arm 80.

As similarly shown in FIG. 2, tape supply sensor 44 in FIG. 3 is a proximity sensor mounted on the bracket 58 and mounted in close proximity to the motion plane of the dancer arm 60 and capable of providing a signal to the control system 32 when dancer arm pivots in response to a low or depleted tape supply, and passes over or blocks the proximity sensor. One example of a commercially available dispensing proximity sensor and tape supply sensor is a 2 mm NPN shielded proximity sensor, Model No. E2ASO8KSO2M5C1, available from Omron Electronics, LLC, St. Charles, Ill.

Figure 4:
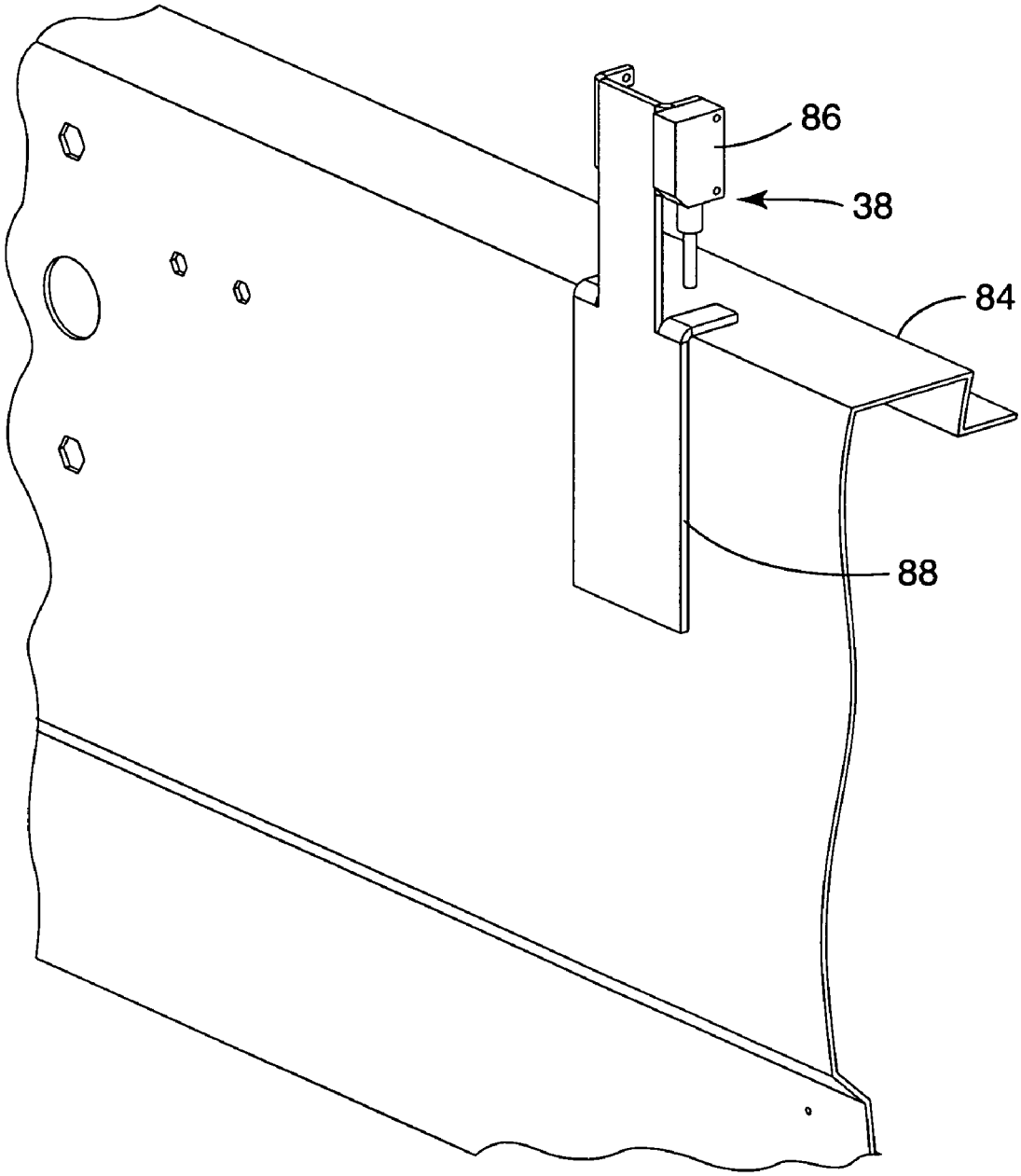
FIG. 4 is a view of an embodiment of an object presence sensor for use in a tape monitoring system in accordance with the invention.

Referring now to FIG. 4, an object presence sensor 38 is mounted on a frame member 84 of the box sealing machine 10. Generally, the object presence sensor 38 is mounted on the box sealing machine 10 near taping heads 26, 28, desirably near the cutting arm assembly 306 of the lower taping head (if present) and adjacent the conveyer path of the box sealing machine that an object to be taped would traverse, as shown in FIG. 1. If only an upper taping head is present, then the object presence sensor is located near the cutting arm assembly 306 of the upper taping head. In this embodiment, the object presence sensor comprises a photoelectric sensor 86 mounted in a rigid mounting frame 88. The photoelectric sensor 86 is capable of providing a signal to the control system 32 when an object, such as a box, blocks the photoelectric sensor 86 and stops providing the signal when an object no longer blocks the photoelectric sensor 86.

Figure 7:
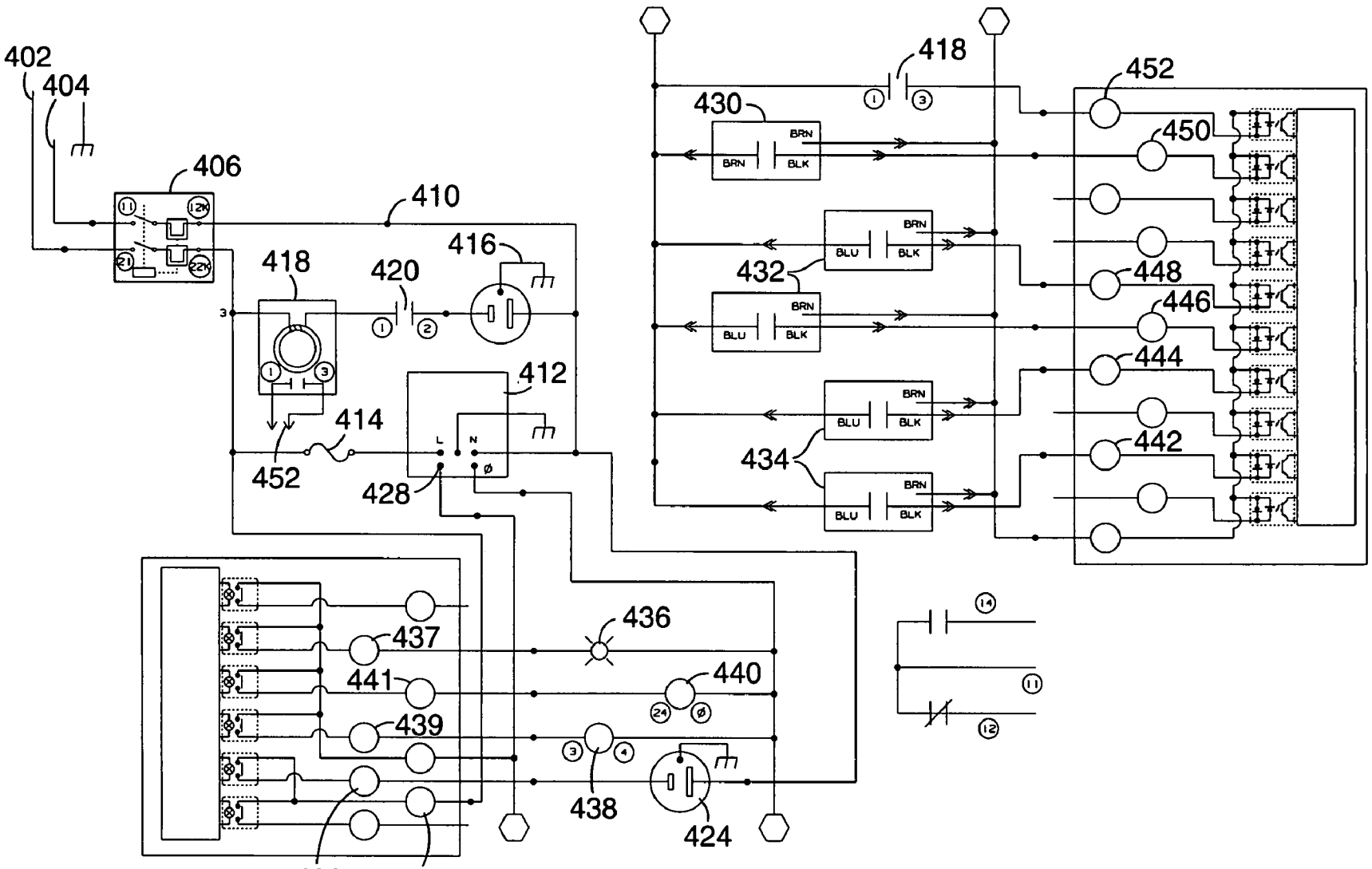
FIG. 7 is a schematic of an embodiment of a control system usable in a tape monitoring system in accordance with the invention.

FIG. 7 shows a detailed schematic of an embodiment of a control system 400 for the tape monitoring system of the invention. Power enters the control system on lines 402 and 404 and terminates at circuit breaker 406. Output lines 408 and 410 supply power to a programmable logic controller (PLC) 412 through a fuse 414; to the box sealing power cord 416 through AC current sensor 418 and through solid state relay 420; and to common line 422 which supplies AC power to optional external warning device power cord 424 through PLC output 426. The PLC 412 has an internal 24 V DC power supply 428 that supplies low voltage DC power to the object presence sensor 430, tape dispensing sensors 432, tape supply sensors 434, and panel indicator 436 through output 437, solid state relay 438 through output 439, and relay for any optional exit conveyer 440 through output 441. PLC input lines 442, 444, 446, 448, and 450 are inputs for tape supply sensors 434, tape dispensing sensors 432, and object presence sensor 430.

Figure 8:
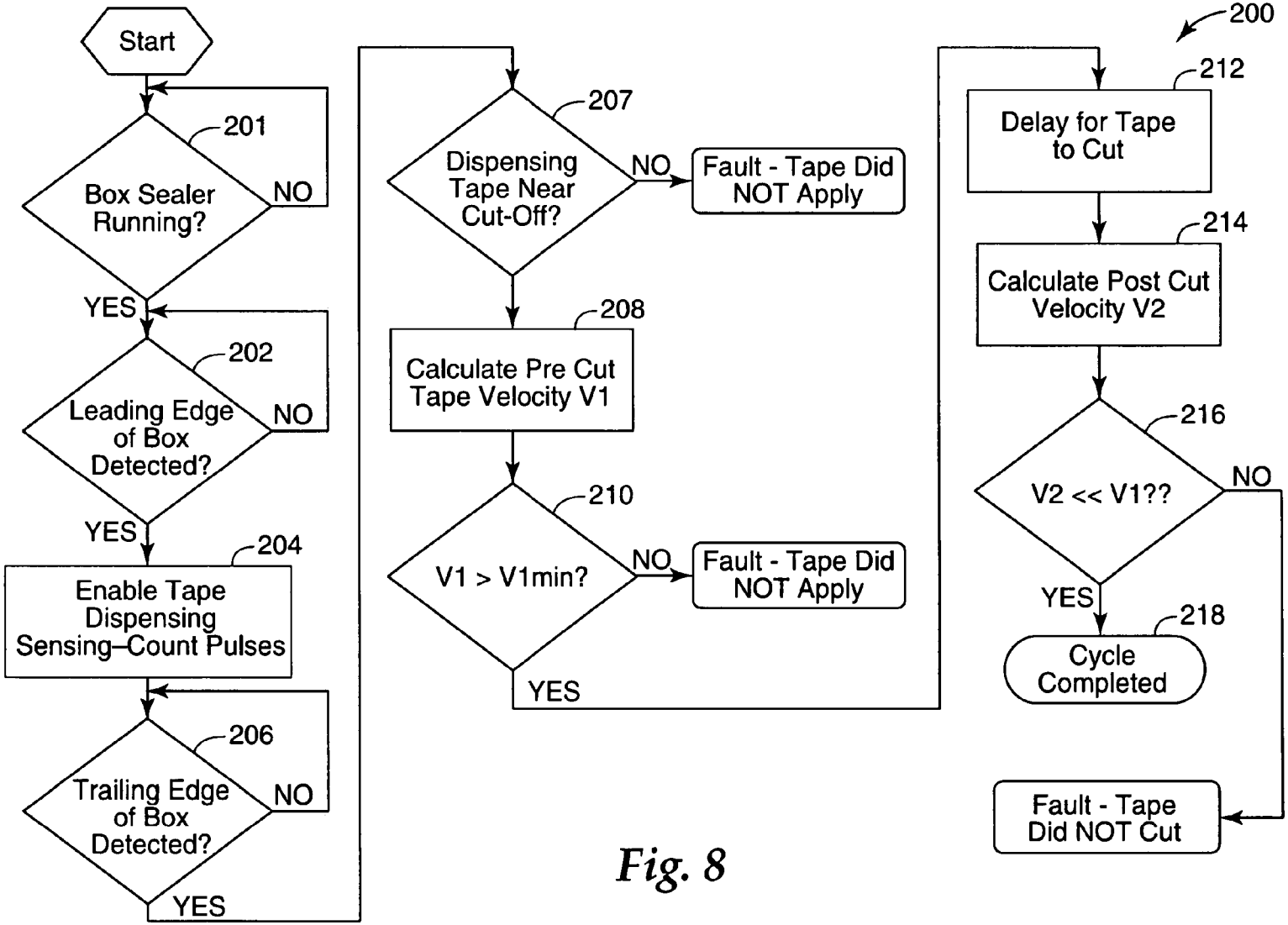
FIG. 8 is a block diagram of an embodiment of an algorithm used in a control system of a tape monitoring system of the invention for detecting potential error conditions.

FIG. 8 shows a block flow algorithm 200 used in a control system in an embodiment of a tape application monitoring system of the present invention. In box 201, the first step is whether the control system detects if the box sealing machine is running. For example, in one embodiment, the control system detects whether or not the box sealing machine is running by means of a current sensor for detecting whether current flow is directed through conveyor motors. The current sensor is also used to sense the presence of an operator reset by the actuation of the ON/OFF pushbutton of the box sealing machine resulting in clearing any existing faults and re-enabling the box sealing machine.

In box 202, the second step is whether the leading edge of a box is detected by the object presence sensor as it passes into the box sealing machine. In the third step 204, having detected a leading edge of a box, the control system begins to count the number of pulse responses per unit of time from the targets passing the tape dispensing proximity sensor as the rollers turn as tape is being applied to the box via the taping heads. In the fourth step 206, the trailing edge of the box intercepts the object present sensor and pulse counting concludes.

In the fifth step 207, the control system dwells until the trailing edge of the box is in proximity to the cutting mechanism of the taping head. If the object present sensor is placed near the cutting mechanism, this dwell time is very small.

In the sixth step 208, the pre-cut tape velocity V1 is calculated (V1=[Encoder Constant×Pulse Counts]/Elapsed Time) wherein the term "Encoder Constant×Pulse Counts" equals the length of tape dispensed and the "Elapsed Time" is the time period from when the object presence sensor 38 first detects the leading edge of box 20 until trailing edge of the box passes the object presence sensor and the object presence sensor no longer detects the box. The "Encoder Constant" is the linear distance of travel per single pulse count in inches/pulse from rotation of roller 64

In the seventh step 210, the first software filter compares the pre-cut velocity V1 to a minimum velocity V1min. If V1 is less that V1min, a fault is generated and power to the system is interrupted, and a warning system is activated. In step eight 212, if V1 is greater than Vmin, the control system dwells for a very short period of time, for example, 0.1 s, to insure the trailing edge of the box has cleared the cutting mechanism of the taping head and the tape cutting operation has completed.

In step nine 214, a post cut tape velocity V2 is calculated from an accumulation of pulses measured per unit time from the tape dispensing proximity sensor. Under normal operation with the tape cut properly, the angular velocity of the tape supply roll will slow down, generating fewer accumulated pulses per unit time from the tape dispensing proximity sensor.

In step ten 216, a second software filter compares the post cut tape velocity V2 to the pre-cut tape velocity V1 and expects V2 to be at least a predetermined level less than V1 (for example V2<0.5 V1), if the tape was properly cut. If V2 is not sufficiently less than V1, a fault is generated and power to the system is interrupted and a warning system may be activated. In the final step 218, the cycle completes and resets for the next box to be taped.

Referring now again to FIG. 7 when power is supplied to PLC 412 the algorithm executes, and assuming no errors, turns on output 439 which supplies the control voltage to relay 438. With relay 438 energized, AC power is supplied to the box sealing machine through power cord 416. When the latching on/off pushbutton (not shown) is depressed, current begins to flow through circuit breaker 406, current sensor 418, and relay 420 to power cord 416. With current to the box sealing machine, current sensor 418 detects current above a preset level and turns on internal relay input 452 at PLC 412. PLC 412 then scans for the presence of an object through an output from object presence sensor 430 before beginning the sequence of operation. In the case where a fault is detected, output 439 from the PLC 412 is momentarily turned off to de-energize the box sealing machine and then turned on to re-enable the box sealing machine after reset. Additionally, outputs 437 and 426 are pulsed on and off to indicate a fault condition while output 441 is turned off to prevent defective product from exiting the box sealing machine. The fault condition is cleared by pressing the circuit latching on/off pushbutton (not shown) of the box sealing machine, allowing current to flow through current sensor 418.

Figure 9:
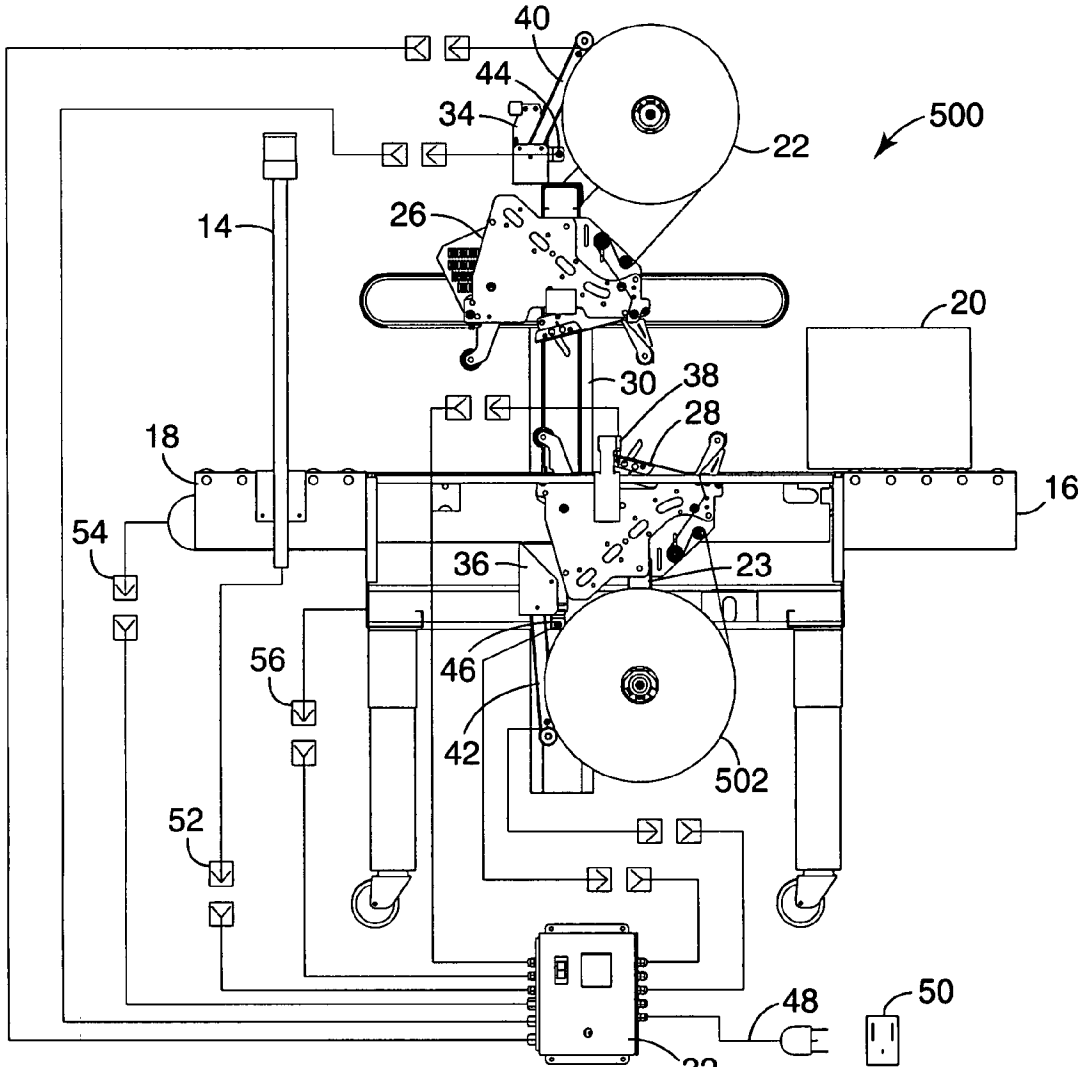
FIG. 9 is a schematic drawing of another embodiment of a box sealing machine combined with an embodiment of a warning device and a tape monitoring system in accordance with the present invention.

FIG. 9 shows an alternate embodiment of a box sealing machine having a tape monitoring system. Box sealing machine 500 is similar in all respects to box sealing machine 10 in FIG. 1 except lower tape supply roll 502 is positioned substantially below lower taping head 28.

Foreseeable modifications and alterations of this invention will be apparent to those skilled in the art without departing from the scope and spirit of this invention. This invention should not be restricted to the embodiments that are set forth in this application for illustrative purposes.

What is claimed is:

1. A tape monitoring system for use with a taping device including at least one taping head and a tape supply for applying tape to an object as the object is moved relative to the taping head, the tape monitoring system comprising:

a tape dispensing sensor for determining whether tape is being dispensed from the tape supply and capable of providing a signal relating to a tape dispensing velocity;

an object presence sensor for determining whether an object is present for taping and capable of providing a response when the object is present; and a control system operatively connected to the tape dispensing sensor and the object presence sensor for determining a potential error condition if either (A) the object presence sensor provides a response and the tape dispensing velocity is less than a first preset tape dispensing velocity, or (B) the object presence sensor no longer provides a response and the tape dispensing velocity is greater than a second preset tape dispensing velocity;

wherein the tape dispensing sensor and the object presence sensor are positioned independent of the taping head.

2. The tape monitoring system of claim 1 further comprising a tape supply sensor.

3. The tape monitoring system of claim 1 wherein the control system comprises a current sensor.

4. The tape monitoring system of claim 1 wherein the control system further comprises a warning device that is activated when a potential error condition is determined.

5. The tape monitoring system of claim 2 wherein the control system activates a warning device upon receiving a response from the tape supply sensor.

6. The tape monitoring system of claim 1 wherein power to the taping device is interrupted when a potential error condition is determined.

7. The tape monitoring system of claim 1 wherein the tape dispensing sensor comprises a dancer arm pivotably mounted on one end and having a roller rotatably mounted at another end and a dispensing proximity sensor mounted adjacent the roller such that rotation of the roller is detectable by the dispensing proximity sensor.

8. The tape monitoring system of claim 1 wherein the object presence sensor comprises a photoelectric sensor.

9. The tape monitoring system of claim 1 wherein the first preset tape velocity is a pre-cut tape velocity and the second preset tape velocity is a post cut tape velocity, and wherein the second preset tape velocity is about 0.5 times the first preset tape velocity.

10. The tape monitoring system of claim 1 wherein the control system comprises a programmable logic controller.

11. A taping device comprising:

at least one taping head capable of applying tape to an object as the object is moved relative to the taping head;

a tape supply for the taping head; and a tape monitoring system comprising a tape dispensing sensor for determining whether tape is being dispensed from the tape supply and capable of providing a signal relating to a tape dispensing velocity;

an object presence sensor for determining whether an object is present for taping and capable of providing a response when the object is present; and a control system operatively connected to the tape dispensing sensor and the object presence sensor for determining a potential error condition if either (A) the object presence sensor provides a response and the tape dispensing velocity is less than a first preset tape dispensing velocity, or (B) the object presence sensor no longer provides a response and the tape dispensing velocity is greater than a second preset tape dispensing velocity;

wherein the tape dispensing sensor and the object presence sensor are positioned independent of the taping head.

12. The taping device of claim 11 wherein the tape monitoring system further comprises a tape supply sensor.

13. The taping device of claim 11 wherein power to the taping device is interrupted when a potential error condition is determined.

14. The taping device of claim 11 having an upper taping head and tape supply and a lower taping head and tape supply and a tape dispensing sensor for each tape supply.

15. The taping device of claim 11 wherein the control system further comprises a warning device that is activated when a potential error condition is determined.

* * * * *

UNITED STATES PATENT AND TRADEMARK OFFICE

CERTIFICATE OF CORRECTION

PATENT NO. : 7,665,498 B2
APPLICATION NO. : 11/280137
DATED : February 23, 2010
INVENTOR(S) : Bredl et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1135 days.

Signed and Sealed this

Seventh Day of December, 2010

David J. Kappos

David J. Kappos
*Director of the United States Patent and Trademark Office*